United States Patent [19]

Steward

[11] 4,199,868

[45] Apr. 29, 1980

[54] AMUSEMENT DEVICE FOR TRACING GEOMETRICAL FIGURES

[76] Inventor: R. James Steward, 100 Francois, Florissant, Mo. 63031

[21] Appl. No.: 12,866

[22] Filed: Mar. 5, 1979

[51] Int. Cl.[2] ..... B43L 11/00

[52] U.S. Cl. ..... 33/27 L

[58] Field of Search ..... 33/27 L, 78; 248/425, 248/349; 308/188, 201, 227

[56] References Cited

U.S. PATENT DOCUMENTS

| | | | |
|---|---|---|---|
| 850,552 | 4/1907 | Werner | 33/27 G |
| 1,754,094 | 4/1930 | Glass | 248/349 |
| 2,215,462 | 9/1940 | Davidson et al. | 33/78 UX |
| 3,516,193 | 6/1970 | Engelman | 33/27 L X |
| 3,590,488 | 7/1971 | Padowicz | 33/27 L |
| 4,067,111 | 1/1978 | Truitt | 33/27 L |

*Primary Examiner*—Harry N. Haroian

*Attorney, Agent, or Firm*—Cohn, Powell & Hind

[57] ABSTRACT

An amusement device including a base and a support carried by the base for suspending a pendulum above a marking surface. The pendulum includes a marker for tracing figures on the marking surface which is provided by a granular material contained in a bowl carried by the base. As the pendulum swings to and fro, the bowl can be rotated to control the tracing of geometrical figures on the marking surface.

3 Claims, 8 Drawing Figures

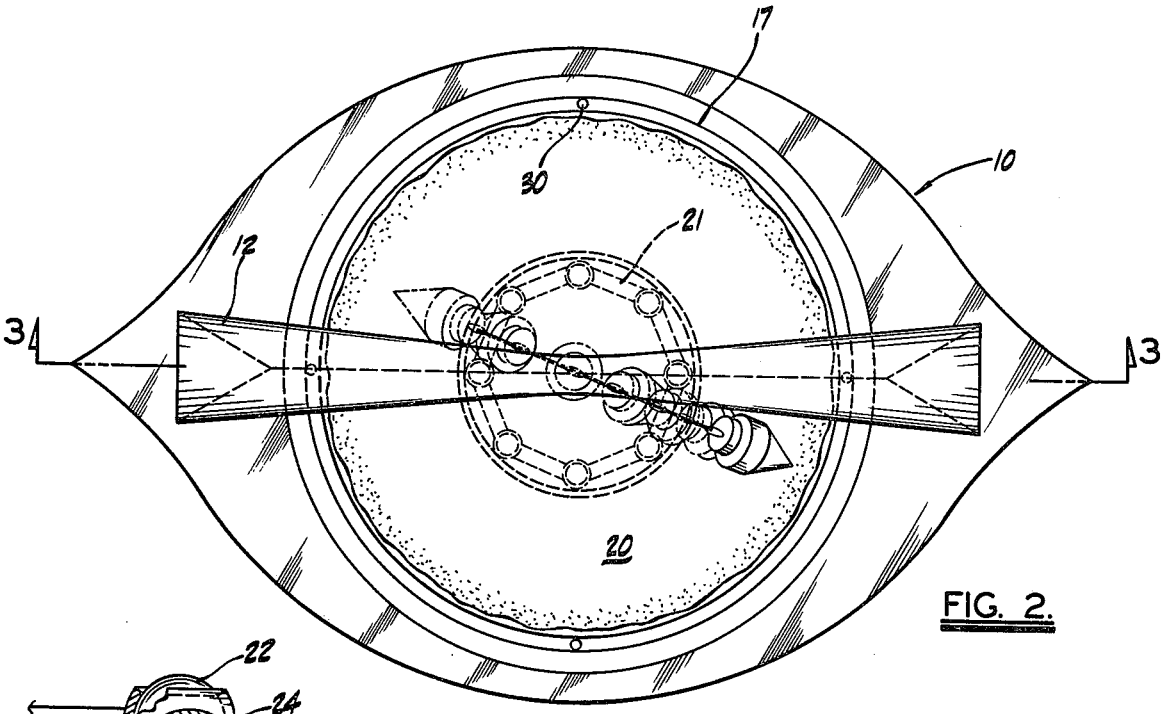
FIG. 2.
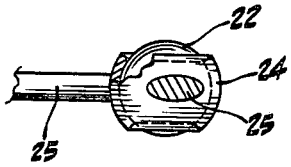
FIG. 5.
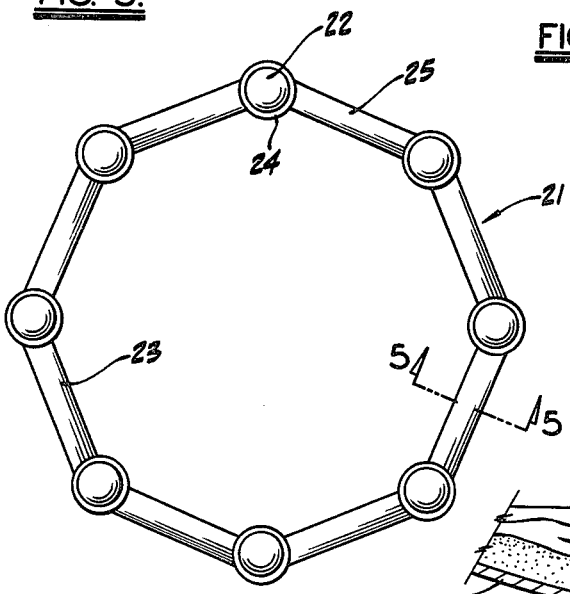
FIG. 4.
FIG. 7.
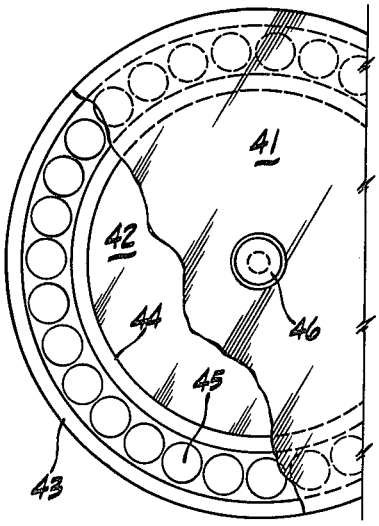
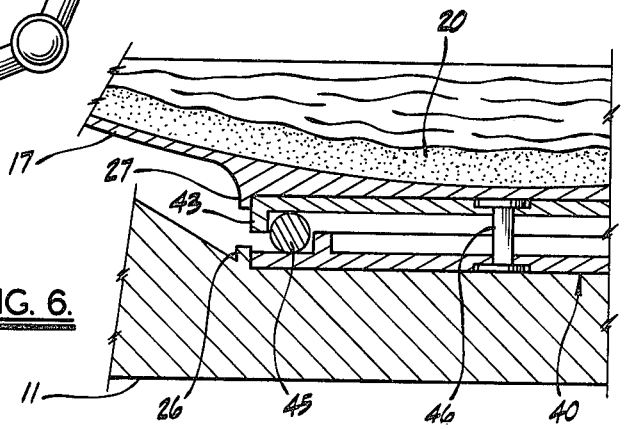
FIG. 6.

AMUSEMENT DEVICE FOR TRACING GEOMETRICAL FIGURES

BACKGROUND OF THE INVENTION

This invention relates to an amusement device for tracing geometrical figures and particularly to a device employing a pendulum.

Devices for tracing geometrical figures are known. For example, the prior art discloses devices having a substantially fixed writing instrument used in conjunction with a swinging writing surface. One such device provides a flat writing surface suspended by three or more cables to produce eccentric motion of the writing surface with reference to a marker pivotally attached to a fixed frame. Another device provides a flat writing surface attached to a pendulum and marked upon by a spring loaded marker. Neither of these known devices provide the simplicity and flexibility in drawing geometrical patterns afforded by the present device.

SUMMARY OF THE INVENTION

This amusement device provides a pendulum marker for tracing geometrical figures on a marking surface disposed below the pendulum.

The device includes a base means and a support means carried by the base means. Means providing a marking surface is carried by one of said means and a pendulum means is attached to the support means in suspended relation above the marking surface, the pendulum means including a marking means engageable with the marking surface for tracing figures thereon.

According to one aspect of the invention the marking surface is provided by a quantity of loosely packed granular material and the marking means is provided by a plumb bob which is part of the pendulum means.

In another aspect of the invention the means providing the marking surface is rotatably mounted to the base means to provide for rotation of the marking surface in addition to the swinging of the pendulum means to and fro for tracing more complex geometric patterns.

In a further aspect of the invention the means providing the marking surface includes a container of loosely packed granular material.

In yet another aspect of the invention bearing means is disposed between the base means and the container permitting rotation of the container relative to the base means In still another aspect of the invention the bearing means includes a peripheral frame having a plurality of spaced retaining means each including an associated bearing element mounted in rotatable relation therewithin.

In another aspect of the invention the bearings are spherical and protrude above and below the bearing frame, a larger portion of each of the spherical bearings protruding above the bearing frame than below the bearing frame.

In another aspect of the invention the container includes a handle for controlling rotation thereof.

In yet another aspect of the invention the base includes a catchment groove disposed below the container to receive overflow granular material.

In another aspect of the invention the pendulum includes a resiliently flexible elongate member substantially rigidly attached to the support frame.

BRIEF DESCRIPTION OF THE DRAWINGS

FIG. 2 is a top plan view thereof;

FIG. 4 is an enlarged top plan view of the bearing frame assembly;

FIG. 5 is a fragmentary cross sectional view taken on line 5—5 of FIG. 4;

FIG. 6 is a fragmentary longitudinal cross sectional view of a modified bearing assembly;

FIG. 7 is a fragmentary top plan view of the modified bearing assembly, and

DESCRIPTION OF THE PREFERRED EMBODIMENT

Figure 1:
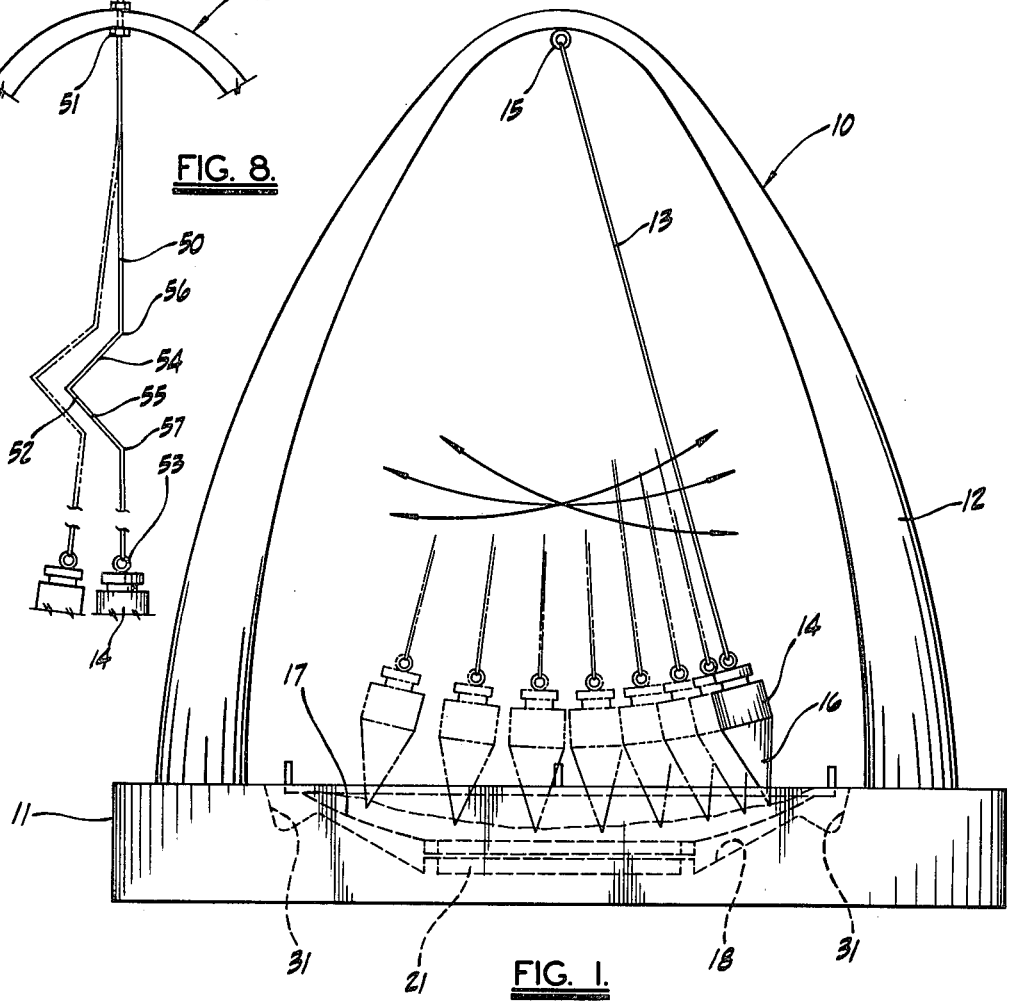
FIG. 1 shows a front elevational view of the device.

Referring now be reference numerals to the drawings and first to FIGS. 1 and 2, it will be understood that the amusement device, generally indicated by numeral 10, includes a base 11, having a generally arcuate configuration, and an arch 12 carried by the base 11 and attached thereto, as by adhesive.

The arch 12 is generally triangular in cross section and provides a support means for a pendulum which includes a line 13, constituting an elongate flexible element, and bob 14 which, as shown, is a generally conical plumb bob. One end of the line 13 is attached to the apex of the intrados of the arch 12 by an eye 15 while the other end of the line 13 is attached to the bob 14. The bob 14 is tapered to a point 16 which provides a marking means for a marking surface carried by the base 11, as will now be described.

As clearly shown in FIG. 2, a bowl 17 is carried by the base 11 within a depression 18 located between the legs of the arch 12. The bowl 17 provides a container for a quantity of loosely packed granular material, such as graded sand 20, which in the preferred embodiment provides the marking surface.

As will be readily understood the bob 14 may be moved manually from a rest position, in which the line 13 and bob 14 are hanging vertically from the arch 12, toward the edge of the bowl 17 and then released which allows said bob to start swinging in a pendulum fashion. As the bob 14 swings to and fro the point 16 engages the surface of the sand 16, and traces a pattern therein.

Figure 3:
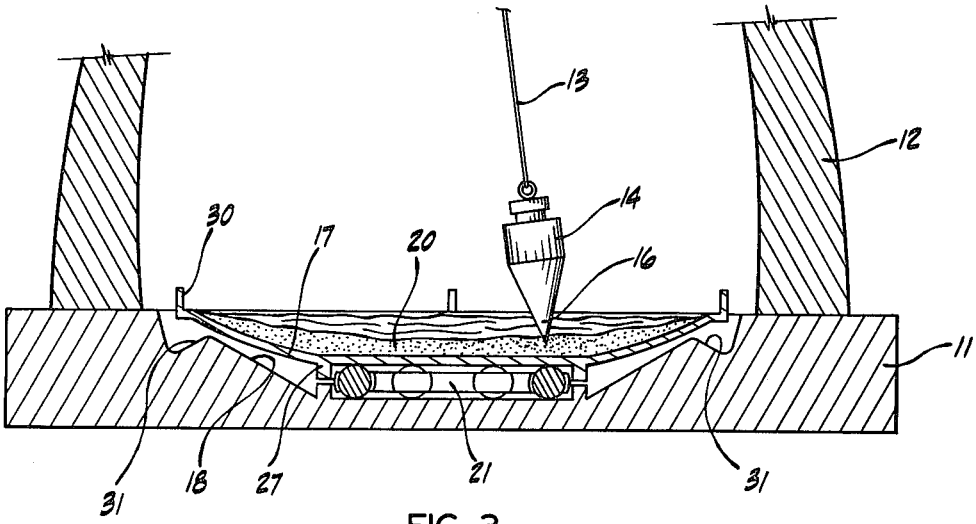
FIG. 3 is a fragmentary longitudinal cross sectional view taken on Line 3—3 of FIG. 2.

In the preferred embodiment, a bearing assembly indicated generally by 21 is disposed between the bowl 17 and the base 11 to provide relative rotation between said bowl and said base. As shown in FIGS. 3, 4 and 5, the bearing assembly 21 includes a plurality of spherical bearings 22 mounted in a bearing frame 23. The frame 23 is formed from a plurality of generally arcuate retainer sheath members 24, compatibly configurated to receive said bearings 22 in rotatable relation, and interconnected by frame members 25 integrally formed with said retainer members. The spherical bearings 22 protrude above and below the bearing frame 23, a larger portion of each of said bearings 22 protruding above the retainer members 24 than below said members as most clearly shown in FIG. 5.

As shown in FIG. 3, the base 11 and the bowl 17 each include a peripheral lip 26 and 27 respectively which are oppositely disposed to each other and cooperate to provide a retaining means for the bearing assembly 21 to ensure that said bowl rotates about a substantially fixed axis relative to said base.

The bowl 17 includes a plurality of projecting elements providing handles 30. To rotate the bowl 17 the handles 17 are gripped by the fingers and the bowl is moved manually in either a clockwise or counterclockwise direction.

A circumferential trough 31 is included in the base 11 to catch and collect any overflow of sand particles which may fall from the bowl 17 so that said particles do not interfere with the smooth operation of the bearings.

A modified bearing assembly is shown in FIGS. 6 and 7. This assembly, indicated by 40 includes upper and lower bearing plates 41 and 42 respectively, having associated circumferential lips 43 and 44 which cooperate to retain a plurality of loose spherical bearings 45. The bearing plates 41 and 42 are connected to each other by a pivot pin 46 and are retained, relative to the bowl 17 and the base 11 respectively as by lips 27 and 26.

Figure 8:
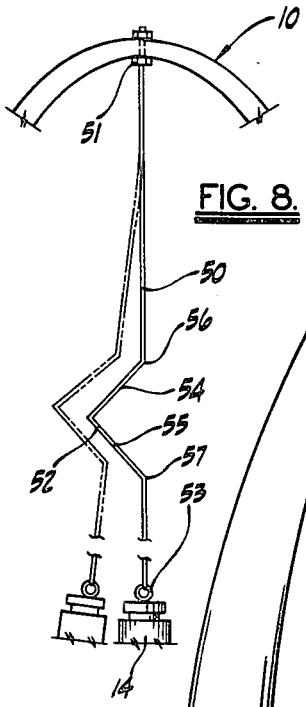
FIG. 8 is a fragmentary view of a modified pendulum.

A modified pendulum is shown in FIG. 8. This pendulum includes a thin rod 50, constituting a resiliently flexible elongate member, and may be formed from metal, plastic or the like. This member is substantially rigidly connected at the upper end to the arch 12, as by a pair of spaced nuts 15 or as by welding, and is connected at the lower end either rigidly or freely to the bob 14. The rod 50 includes an intermediate portion 52 formed from transverse elements such as those indicated by 54 and 55. These elements provide an interruption to the uniformity of the rod 50 provide a stiffness differential such that the upper and lower ends of the intermediate portion indicated by 56 and 57 respectively more transversely relative to each other a different amount than movement which would be experienced over the same distance by an initially straight, uniform rod. This interruption provides the pendulum with compound movement and provides harmonic variations in the traced patterns.

It is thought that the structural features and functional advantages of this amusement device have become fully apparent from the foregoing description of parts, but for completeness of disclosure the operation of the device will be briefly discussed.

The sand 20 is smoothed to form a slightly concave marking surface. The bob 13 is manually drawn to one side of the bowl 17 and released so that the pendulum swing is either straight or arcuate. The bob point 16 engages the sand 20 causing lines to be traced therein as said bob swings to and fro.

The bowl 17 is rotatable and may be manually moved in clockwise and counterclockwise directions. This rotation is accomplished by gripping the handles 30 and exerting the desired rotational force on the bowl 15 to either spin the bowl or to move it in a controlled manner to another position.

As the bowl 17 is rotated and the bob point swings to and fro, different geometric patterns are traced in the sand than would be the case with a stationary bowl. The patterns are determined by the swing of the marking means provided by the bob point 16, and the rotation of the marking surface provided by the sand 20. Accordingly, variations in the traced patterns can be accomplished by varying the movement of the marking surface as by spinning the bowl 17 or moving it accurately back and forth.

When it is desired to trace a new pattern the sand 20 is resmoothed and the marking process is again begun.

It will be understood that the various components of the device can in general be made of any suitable material such as metal or plastic, although, in the case of the plumb bob a relatively heavy material such as metal is to be preferred.

I claim as my invention:

1. An amusement device for tracing geometrical figures, comprising:
   (a) means for providing a base,
   (b) an arch member operatively carried by the base,
   (c) means providing a marking surface carried by the base,
   (d) pendulum means attached to the arch member in suspended relation above the marking surface and including marking means engageable with the marking surface for tracing figures thereon, and
   (e) bearing means disposed between the base and the container permitting rotation of the container relative to the base,
   (f) the means providing the marking surface including a container of loosely packed granular material mounted on the base, said granular material providing the marking surface, and
   (g) the base including a substantially circumferential trough disposed below the container to receive overflow granular material.

2. An amusement device as defined in claim 1, in which:
   (h) the pendulum means includes an elongate, resiliently flexible element having an upper end substantially rigidly connected to the arch member, a lower end having a bob at the end thereof providing the marking means and an intermediate portion subjected to the downward pull by the bob and providing a different transverse movement differential between the limits thereof than would be experienced by an elongate, resiliently flexible element of uniform thickness and material.

3. An amusement device for tracing geometrical figures, comprising:
   (a) a base,
   (b) an arch member having legs rigidly mounted to the base,
   (c) a bowl freely rotatively mounted to the base for rotation about a fixed axis between the legs of the arch member and having a quantity of loosely packed granular material disposed within the bowl to provide a marking surface, the bowl including at least one handle means for controlling rotation thereof, and
   (d) a pendulum means including an elongate flexible member attached to the arch member in suspended relation above the base, and a plumb bob having a pointed end engageable with the controlled, rotatable granular material marking surface for tracing figures thereon.

* * * * *